US009224559B2

(12) United States Patent
Kralik et al.

(10) Patent No.: US 9,224,559 B2
(45) Date of Patent: Dec. 29, 2015

(54) UNIDIRECTIONALLY SWITCHING DC CONTACTOR

(75) Inventors: Robert Kralik, Poing (DE); Andrej Ignatov, Munich (DE)

(73) Assignee: SCHALTBAU GMBH, Munich (DE)

( * ) Notice: Subject to any disclaimer, the term of this patent is extended or adjusted under 35 U.S.C. 154(b) by 274 days.

(21) Appl. No.: 13/811,646

(22) PCT Filed: May 12, 2011

(86) PCT No.: PCT/EP2011/002361

§ 371 (c)(1),
(2), (4) Date: Jul. 29, 2013

(87) PCT Pub. No.: WO2012/010227

PCT Pub. Date: Jan. 26, 2012

(65) Prior Publication Data

US 2013/0292359 A1 Nov. 7, 2013

(30) Foreign Application Priority Data

Jul. 22, 2010 (DE) ..... 10 2010 031 907

(51) Int. Cl.

| | |
|---|---|
| ***H01H 33/20*** | (2006.01) |
| ***H01H 9/36*** | (2006.01) |
| ***H01H 1/20*** | (2006.01) |
| ***H01H 9/44*** | (2006.01) |

(52) U.S. Cl.

CPC ..... *H01H 33/20* (2013.01); *H01H 9/362* (2013.01); *H01H 1/20* (2013.01); *H01H 9/443* (2013.01)

(58) Field of Classification Search

CPC ..... H01H 9/46; H01H 9/443; H01H 33/596
USPC ..... 218/22, 23, 26, 31, 148; 200/243; 335/153, 207

See application file for complete search history.

(56) References Cited

U.S. PATENT DOCUMENTS

| | | | | |
|---|---|---|---|---|
| 4,080,520 | A * | 3/1978 | Muller | 218/148 |
| 4,766,273 | A * | 8/1988 | Butterworth et al. | 218/40 |
| 5,004,874 | A * | 4/1991 | Theisen et al. | 218/151 |

(Continued)

FOREIGN PATENT DOCUMENTS

| | | |
|---|---|---|
| DE | 1 246 851 B | 8/1967 |
| DE | 28 26 243 | 12/1979 |
| EP | 1 884 969 A1 | 6/2007 |

OTHER PUBLICATIONS

International Search Report on PCT/EP2011/002361. Date mailed Dec. 5, 2011. 5 pages.

*Primary Examiner* — Renee Luebke
*Assistant Examiner* — William Bolton
(74) *Attorney, Agent, or Firm* — Kilpatrick Townsend & Stockton LLP

(57) ABSTRACT

Disclosed is a unidirectionally switching direct-current contactor, having a double break having two contact points, which each have a fixed contact and a movable contact, wherein the movable contacts are arranged on a contact bridge and wherein a switch arc is formed at each of the contact points when the contact points open, and including an arc quenching device and having at least one blowing device for blowing at least one of the switch arcs from the corresponding contact point. The contactor includes a jumper plate arranged adjacently to the movable contact of the first contact point, wherein the contact bridge and the jumper plate are electrically insulated from each other and the jumper plate is connected potentially to the fixed contact of the second contact point.

12 Claims, 1 Drawing Sheet

(56) References Cited

U.S. PATENT DOCUMENTS 5,138,122 A * 8/1992 Moldovan et al. ..... 218/22
5,546,061 A * 8/1996 Okabayashi et al. ..... 335/78
6,064,024 A * 5/2000 Moldovan ..... 218/22
7,417,520 B2 * 8/2008 Kralik ..... 335/201
2009/0057273 A1 * 3/2009 Kil ..... 218/149

* cited by examiner

UNIDIRECTIONALLY SWITCHING DC CONTACTOR

This application is a U.S. National Phase under 35 USC 371 of PCT Application No. PCT/EP2011/002361 filed May 12, 2011, which claims priority to the German Application No. 10 2010 031 907.4, filed Jul. 22, 2010, the disclosures of which are incorporated by reference herein.

The present invention relates to a unidirectionally switching direct-current contactor, comprising a double break with two contact points, which each have a fixed contact and a movable contact, wherein the movable contacts are arranged on a contact bridge and wherein a switch arc is formed at each of the contact points when the contact points open, and comprising a light arc quenching device and a blowing device for blowing at least one of the switch arcs away from the respective contact point.

Such unidirectionally switching direct-current contactors are used e.g. in railroad applications and switch direct currents with a nominal voltage of up to 3 kV.

A contactor with double break is known e.g. from DE 1 246 851 . This document shows direct-current switching devices with multiple break, for example, with bridge contacts. A light arc quenching device with deion plates is assigned to each contact point of the direct-current switching devices. Additionally, permanent magnets are provided in the direct-current switching devices, which permanent magnets blow the generated switch arcs into the light arc quenching devices. Since a light arc quenching device is assigned to each contact point, this contactor has a relatively high space requirement.

Hence, it is the object of the present invention, to provide a unidirectionally switching direct-current contactor, which is compact and has a low manufacturing effort.

Herefor it is provided according to the present invention, that adjacent to the moveable contact of the first contact point, a jumper plate is arranged, wherein the contact bridge and the jumper plate are electrically insulated from each other, and the jumper plate is connected potentially to the fixed contact of the second contact point, so that the first switch arc of the first contact point jumps from the contact bridge to the jumper plate due to the blowing by the blowing device and thus the second switch arc at the second contact point is bridged.

Consequently, the direct-current contactor according to the invention is characterised by a very simple design. Since the second switch arc at the second contact point is bridged when the first switch arc jumps from the contact bridge to the jumper plate, the second switch arc is easily extinguished there. Hence, only the first switch arc remains, which is blown by the blowing device into the light arc quenching device and is extinguished there. Hence, only one light arc quenching device has to be provided. Thereby, the direct-current contactor has the desired compactness and the low manufacturing effort.

According to a preferred embodiment of the invention, the light arc quenching device may be arranged adjacent to the first contact point. The first switch arc generated at the first contact point consequently only has to cover a small distance to the light arc quenching device and is consequently quickly extinguished. Loss of contact material in the contactor may thereby be prevented.

In order to enable a simple design of the direct-current contactor, it may be provided that the contact bridge and the jumper plate are separated by an air gap.

In yet another embodiment of the invention, it may be provided that the jumper plate is formed as a light arc guiding plate and at least sectionwise surrounds an edge portion of the light arc quenching device. One of the light arc base points of the first switch arc is thereby led on this light arc guiding plate along the light arc quenching device. Thereby, the first switch arc is stretched and along its length blown into the light arc quenching device. Thus, a quick and safe extinguishing of the remaining first switch arc is assured, the direct-current contactor has a good quenching function.

Further, it may also be provided that the fixed contact of the first contact point is connected to a second light arc guiding plate. Preferably, the fixed contact is only elongated and thereby integrally formed with the light arc guiding plate. Thus, also the second light arc base point of the second switch arc is led along the light arc quenching device, such that a further stretching and thereby a safe extinguishing of the first switch arc is assured. Preferably, also the second light arc guiding plate surrounds an edge region of the light arc quenching device.

In yet another variant, it may be provided that in the region of the second contact point, a protective cladding is arranged. Thereby, the surroundings of the second contact point are protected as long as the second switch arc remains at this contact point and is not yet bridged by the jumping of the first switch arc onto the jumper plate. Advantageously, it may be provided that this protective cladding is manufactured from erosion resistant ceramics. However, also an insulated suspended metal element, e.g. made of stainless steel, may be used.

The transfer of the one light arc base point of the first switch arc at the first contact point from the contact bridge onto the jumper plate may be facilitated in that the contact bridge is bent away in the direction of the jumper plate at the end of the contact bridge facing towards the jumper plate.

Advantageously, the blowing device is arranged at the side of the contact bridge facing away from the contact points behind the end of the contact bridge bent away. Thereby, a good protection of the blowing device is made possible.

In order to achieve a very simple construction of the direct-current contactor, it may be further provided that the direct-current contactor is surrounded by a housing, wherein the housing is formed in a two-housing-shell-technology.

According to yet another embodiment, it may be provided that the housing has a removable insert in the region of the light arc quenching device, which insert is connected to light arc quenching elements of the light arc quenching device arranged in this region. The insert with the light arc quenching element may be easily removed and thereby enables an access to the contact points of the contactor, e.g. for maintenance purposes.

In the following, the invention is explained in more detail with reference to the drawings, in which.

Figure 1:
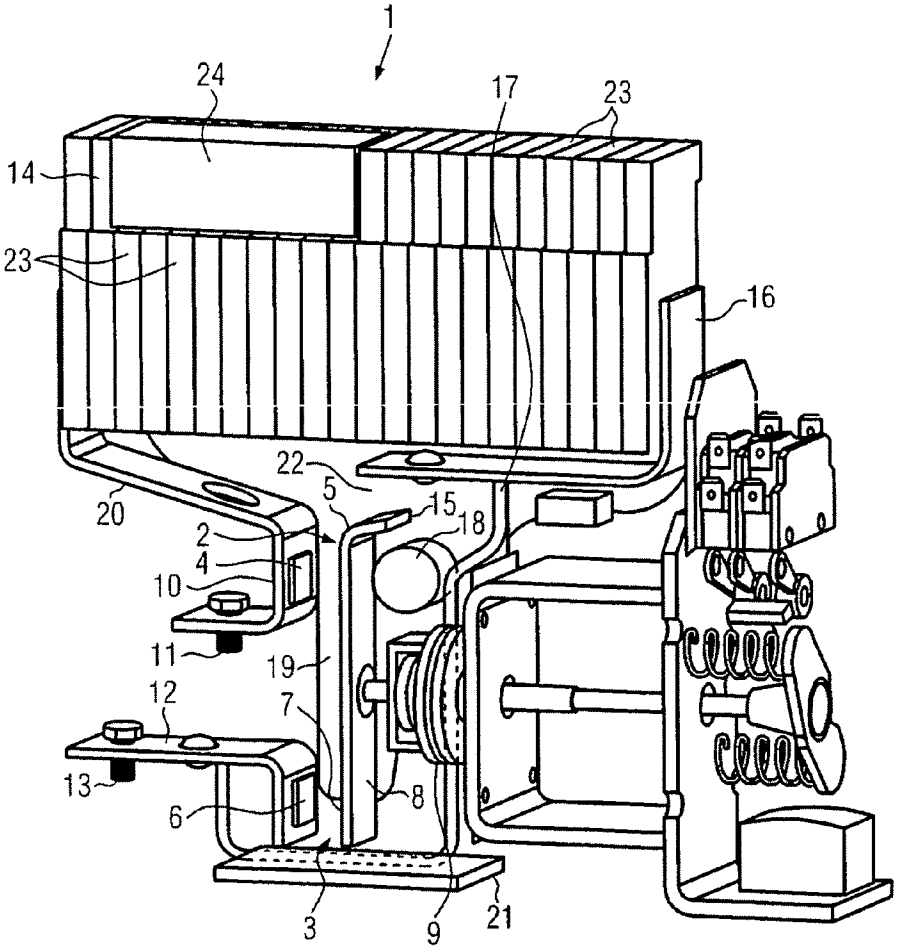
FIG. 1 shows the construction of the direct-current contactor in a perspective view.

As shown in FIG. 1, the direct-current contactor 1 comprises a double break with two contact points 2, 3. Each of the contact points 2, 3 comprises a fixed contact 4, 6 and a moveable contact 5, 7. The moveable contacts 5, 7 are arranged on a common contact bridge 8. The contact bridge 8 is mounted on a moveable contact carrier 9 and via driving mechanisms assigned to the contact carrier 9, the contact bridge may be transferred from a switching position, in which the fixed contacts 4, 6 and the moveable contacts 5, 7 of each of the contact points 2, 3 are in contact with each other, into an open position, in which the fixed contacts 4, 6 and the moveable contacts 5, 7 of the contact points 2, 3 are separated from each other.

The fixed contact 4 of the first contact point 2 is arranged on a first contact bar 10. At the contact bar 10 the first main contact terminal 11 of the direct-current contactor 1 is provided. The fixed contact 6 of the second contact point 3 is arranged on a second contact bar 12. At this second bar 12, the second main contact terminal 13 is provided.

Adjacent to the first contact point 2, a light arc quenching device 14 is arranged. The light arc quenching device 14 comprises a plurality of light arc quenching elements 23, at which a light arc generated during opening the contact points 2, 3 is stretched and forced to cease. The light arc quenching elements may be constituted for example of ceramic or metal. The lower edge of the light arc quenching device 14 is facing towards the first contact point 2. The end portion 15 of the contact bridge 8 facing towards the light arc quenching device 14 is formed bent away. At a distance to this bent away end portion 15 of the contact bridge 8, a jumper plate is arranged. The jumper plate is formed as a first light arc guiding plate 16. The first light arc guiding plate 16 is designed having an L-form and with its long leg surrounds a partial area of the lower edge of the light arc quenching device 14 and with its short leg surrounds a part of the respective side of the light arc quenching device 14. The leg of the light arc guiding plate 16 arranged at the underside of the light arc quenching device 14 is so long that in the opened state of the contact bridge 8, the leg is arranged opposite to the bent away end portion 15 of the contact bridge 8, but does not jut into the opened contact point 2.

The contact bridge 8 and the first light arc guiding plate 16 are electrically isolated from each other. Therefore, an air gap 22 is provided between the bent away end 15 of the contact bridge 8 and the light arc guiding plate. The jumper plate formed as the first light arc guiding plate 16 is potentially connected to the fixed contact 6 of the second contact point 3. Therefore, a connecting strand 17 is provided between the light arc guiding plate 16 and the contact bar 12 at which the fixed contact 6 of the second contact point 3 is arranged. Preferably, the connecting strand 17 is provided with an insulation. Of course, also another connection is possible which provides that the light arc guiding plate 16 and the second contact bar 12 are at the same potential. In the region of the second contact point 3, a protective cladding 21 is arranged. The protective cladding 21 serves for protecting the members of the contactor arranged in the region of the second contact point 3 against the second switch arc generated at the second contact point during opening of the contact point. Especially, a contact with the parts connected to ground has to be prevented. The protective cladding 21 may be manufactured from erosion resistive ceramics. It is also possible, to use an insulated suspended metal element, preferably made of stainless steel or another erosion resistant metal.

At the side of the contact bridge 8 facing away from the contact points 2, 3, a blowing device is arranged. In the illustrated case, this is a permanent magnet 18. Pole plates 19 are assigned to the permanent magnet 18. In FIG. 1, the direct-current contactor 1 is illustrated in an opened state. This means, that above the permanent magnet 18, a further pole plate is arranged, which is not illustrated and which overlays the contact points. The contact points 19 are formed mushroom shaped, but may also have a different form. Starting from the permanent magnet 18, the pole plates 19 broaden upwards and cover the first contact point 2 as well as at least partial areas of the light arc quenching device 14. In the opposite direction, the pole plates 19 taper to a kind of shaft and cover only the second contact point 3. A homogeneous blowing field is generated by the pole plates 19 in the region of the contact points 2, 3 and in the region of the light arc quenching device 14. Therein, the permanent magnet 18 is orientated in such a way that it exerts a Lorentz force onto the switch arcs generated at the contact points 2, 3 during switching, which drives the first switch arc generated at the first contact point 2 towards the light arc quenching device 14. The switch arc generated at the second contact point 3 is driven in the opposite direction. It may also be provided that the pole plates are designed such that they only cover the first contact point and the light arc quenching device, but not the second contact point.

The first contact bar 10, on which the fixed contact 4 of the first contact point 2 is arranged, is elongated in the direction of the light arc quenching device 14, such that a second light arc guiding plate 20 is formed. Also the second light arc guiding plate 20 surrounds a partial area of the underside of the light arc quenching device 14 and extends upwardly towards the side of the light arc quenching device 14 lying opposite to the first light arc guiding plate 16.

Preferably, a Kapton foil is laid within the direct-current contactor 1, which Kapton foil separates the members conducting a current from the members connected to ground.

Figure 2:
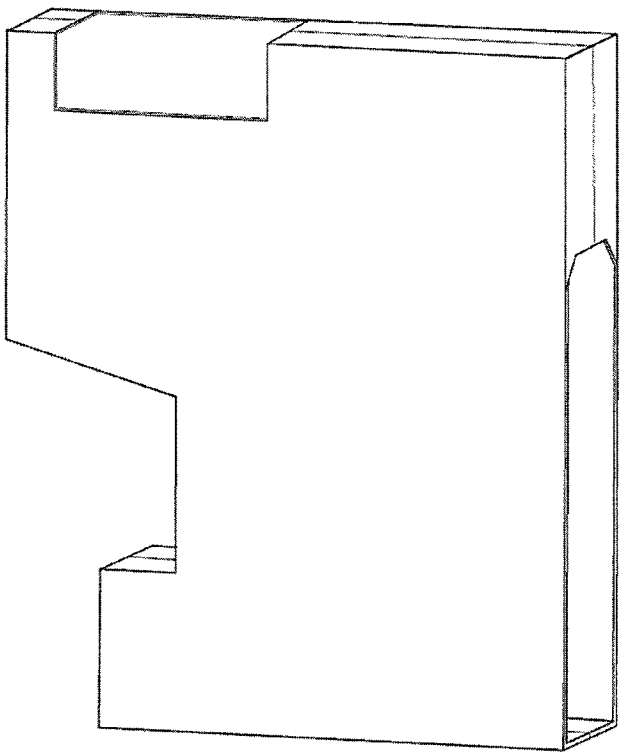
FIG. 2 shows a housing in a perspective view.

In FIG. 1, merely the inner construction of the direct-current contactor 1 is shown. This inner construction is surrounded by a housing 25, shown in FIG. 2. The housing 25 is formed in a two-housing-shell-technology. The direct-current contactor 1 has a very simple construction, whereby a low manufacturing effort is made possible. Since only one light arc quenching device is necessary, the direct-current contactor 1 may be designed very compact.

At the edge portion of the light arc quenching device 14 facing away from the contact points 2, 3, a removable insert 24 is arranged within the housing 25. The insert 24 covers only a partial area of the light arc quenching device 14. The light arc quenching elements 23 arranged in this partial area are connected to the insert, for example, glued or sprayed thereto. The insert 24 is connected to the housing 25 for example by a clips connection and may therefore be easily removed. Since the light arc quenching elements 23 are connected to the insert in this region, they are removed therewith. Thereby, an access to the contact points 2, 3 and to the contact bars 10, 12 is made possible for maintenance purposes for example.

In the following, the functional principle of the direct-current contactor 1 is explained in detail with reference to FIG. 1.

The contact bridge 8 is moved by the driving mechanisms, not illustrated, of the direct-current contactor 1 and by the contact carrier 9. The contact bridge 8 may thereby be transferred from a closed position, in which the contact points 2, 3 are closed and the fixed contacts 4, 6 and the moveable contact 5, 7 of the two contact points touch each other, into an open position. In the open position, the fixed contact 4 and the moveable contact 5 of the first contact point 2 and the fixed contact 6 as well as the moveable contact 7 of the second contact point 3 are separated from each other by an air gap. The contact bridge 8 may of course be returned from the open position to the closed position. During opening of the contact points 2, 3, switch arcs are generated at both contact points 2, 3 between the fixed contacts 4, 6 and the moveable contacts 5, 7. In order to prevent damages at the direct-current contactor 1, these switch arcs have to be extinguished quickly. Due to the permanent magnet 18 and pole plates 19 assigned thereto, a Lorentz force is exerted onto the first switch arc at the first contact point 2, which Lorentz force drives this first switch arc in the direction of the light arc quenching device 14. Also the second switch arc at the second contact point 3 is blown out of the contact point 3 by the Lorentz force and stretched. However, this is not necessary under all circumstances.

Since the current direction of the second switch arc at the second contact point 3 is opposite to the current direction of the first switch arc at the first contact point 2, the second switch arc in FIG. 1 is blown downwardly. In order to prevent damages at the direct-current contactor 1, therefore the protective cladding 21 is arranged in the region of the second contact point 3. The protective cladding 21 is preferably arranged between the first contact point 3 and the connecting strand 17, in order to protect the connecting strand 17 from the second switch arc.

As already described, the first switch arc at the first contact point 2 is blown upwardly, i.e. in the direction of the light arc quenching device 14 by the permanent magnet 18 and the pole plates 19 assigned thereto. Therein, the right light arc base point of the first switch arc jumps from the contact bridge 8 onto the light arc guiding plate 16.

Thereby, the current flow in the direct-current contactor 1 now takes place from the first main contact terminal 11 via the first switch arc onto the light arc guiding plate 16 and via the connecting strand 17 to the second main contact terminal 13. The second switch arc, which is generated at the second contact point 3, is thereby bridged and thus extinguished. Due to the permanent magnet 18 and the pole plate 19, the first switch arc is blown further in the direction of the light arc quenching device 14. The light arc base points of this first switch arc move along the light arc guiding plates 16, 20. Thereby, the first switch arc is widened, forced into the light arc quenching device 14 and extinguished there.

The invention claimed is:

1. A unidirectionally switching direct-current contactor, comprising:

a double break having:

two contact points, which each have:

a fixed contact and a moveable contact, wherein the moveable contacts are disposed on a contact bridge, and wherein a switch arc is formed at each of the contact points when opening the contact points, a light arc quenching device, a blowing device for blowing at least one of the switch arcs out of the respective contact point, and a jumper plate adjacent to the moveable contact of the first contact point, wherein the contact bridge and the jumper plate are electrically insulated from each other and the jumper plate is connected potentially to the fixed contact of the second contact point, such that the first switch arc of the first contact point jumps from the moveable contact of the first contact point onto the jumper plate due to the blowing by the blowing device, and thus the second switch arc at the second contact point is bridged.

2. The direct-current contactor according to claim 1, wherein the light arc quenching device is adjacent to the first contact point.

3. The direct-current contactor according to claim 1, wherein the contact bridge and the jumper plate are separated from each other by an air gap.

4. The direct-current contactor according to claim 1, wherein the jumper plate is a light arc guiding plate and at least partially surrounds an edge portion of the light arc quenching device.

5. The direct-current contactor according to claim 1, further comprising a light arc guiding plate, wherein the fixed contact of the first contact point is connected to the light arc guiding plate.

6. The direct-current contactor according to claim 1, further comprising a protective cladding near the second contact point.

7. The direct-current contactor according to claim 1, wherein an end of the contact bridge is bent away in the direction of the jumper plate and faces the jumper plate.

8. The direct-current contactor according to claim 7, wherein the blowing device is behind the end of the contact bridge.

9. The direct-current contactor according to claim 1, further comprising a two-part shell housing, wherein the housing surrounds the double break, the light arc quenching device, the blowing device, and the jumper plate.

10. The direct-current contactor according to claim 1, wherein the light arc quenching device comprises one or more light arc quenching elements, wherein one or more of the light arc quenching elements are removable to thereby provide access to the contact points.

11. The direct-current contactor according to claim 10, further comprising a removable insert connected to the removable ones of the light arc quenching elements.

12. The direct-current contactor according to claim 10, further comprising:

a housing, wherein the housing surrounds the double break, the light arc quenching device, the blowing device, and the jumper plate, and a removable insert which is removably connected to the housing, wherein the insert is connected to the removable ones of the light arc quenching elements, wherein the insert is removable from the housing to thereby remove the removable ones of the light arc quenching elements and thereby provide the access to the contact points.

* * * * *